US005556269A

United States Patent [19]

Suzuki et al.

[11] Patent Number: 5,556,269

[45] Date of Patent: Sep. 17, 1996

[54] SCROLL-TYPE COMPRESSOR AND METHOD OF ASSEMBLING THE SAME

[75] Inventors: Akira Suzuki, Shimizu; Shigeru Machida, Ibaraki-ken; Isamu Kawano, Shimizu, all of Japan

[73] Assignee: Hitachi, Ltd., Tokyo, Japan

[21] Appl. No.: 396,760

[22] Filed: Mar. 1, 1995

[30] Foreign Application Priority Data

Mar. 18, 1994 [JP] Japan ..... 6-048279

[51] Int. Cl.[6] ..... F04C 18/04; F04C 23/00; B23Q 3/00

[52] U.S. Cl. ..... 418/55.2; 418/55.3; 418/60; 418/101; 29/466; 29/888.022

[58] Field of Search ..... 418/55.2, 55.3, 418/60, 101; 29/464, 466, 888.022

[56] References Cited

U.S. PATENT DOCUMENTS

| | | | |
|---|---|---|---|
| 3,134,369 | 5/1964 | Schlor | 418/101 |
| 4,990,071 | 2/1991 | Sugimoto | 418/55.2 |
| 5,322,426 | 6/1994 | Kolb | 418/55.2 |

FOREIGN PATENT DOCUMENTS

| | | | |
|---|---|---|---|
| 57-76202 | 5/1982 | Japan . | |
| 57-171002 | 10/1982 | Japan | 418/60 |
| 57-193793 | 11/1982 | Japan | 29/888.022 |
| 63-136281 | 9/1988 | Japan . | |
| 1-97086 | 6/1989 | Japan . | |
| 4112982 | 4/1992 | Japan | 29/888.022 |
| 4342801 | 11/1992 | Japan | 418/101 |
| 5-52189 | 3/1993 | Japan | 418/60 |
| 5157076 | 6/1993 | Japan | 418/60 |
| 5-87285 | 11/1993 | Japan . | |

*Primary Examiner*—John J. Vrablik

*Attorney, Agent, or Firm*—Fay, Sharpe, Beall, Fagan, Minnich & McKee

[57] ABSTRACT

A double scroll compressor includes left and right stationary scroll members 2, 3 which are located by knock pins 20. Setting of positions of the right stationary scroll member 3 and an orbiting scroll member 1 relative to each other is achieved by using knock pins 16 to 19. A crankshaft 4 and an auxiliary crankshaft 5 are drivingly coupled through a timing belt under such a condition that their cranks have been in synchronization with a position of their maximum radius.

4 Claims, 3 Drawing Sheets

SCROLL-TYPE COMPRESSOR AND METHOD OF ASSEMBLING THE SAME

BACKGROUND OF THE INVENTION

1. Field of the Invention

The present invention relates to a scroll-type compressor (referred to as "scroll compressor" hereinafter) which is used as an air compressor or as a refrigerant compressor in a refrigeration or air-conditioning system. More specifically, the present invention is concerned with a scroll compressor having scroll wraps on both sides of an end plate and, hence, suitable to be realized as a large-size scroll-type compressor.

2. Description of the Related Art

In a conventional method for assembling a scroll-type fluid machine, the setting of the position of a stationary scroll member and an orbiting scroll member is conducted by bringing these scroll members into meshing engagement with each other, revolving the orbiting scroll while measuring the driving torque, and fixing the stationary scroll at a position where the torque is minimal, as in the case of an oil-less type scroll fluid machine disclosed in Japanese Utility Model Unexamined Publication No. 197086.

An air-cooled oil-less type scroll compressor disclosed in Japanese Utility Model Unexamined Publication No. 63136281 is of a single type which has a scroll wrap formed on only one side of the end plate of an orbiting scroll member. This type of scroll compressor, when required to have a large capacity, has to have a large diameter of scroll members. Increasing the diameter of the scroll members correspondingly increases the axial thrust load acted on the scroll members, which makes it difficult to design and control the compressor as a product. This type of scroll compressor, therefore, could be put to commercial production only when the capacity is as small as 5.5 Kw or less.

To overcome this disadvantage, scroll compressors of the type generally referred to as a "double scroll compressor" have been known in which scroll wraps defining compression chambers are provided on both sides of an end plate of an orbiting scroll member. Scroll compressors of this type can have a capacity exceeding 5.5 Kw, thus obviating the above-described problem. This type of scroll compressor is disclosed, for example, in Japanese patent Unexamined Publication No. 5776202 and Japanese Utility Model Unexamined Publication No. 587285. Thus, a double scroll compressor has scroll wraps on both sides of the end plate of an orbiting scroll member, in order to provide a large capacity. This type of scroll compressor, therefore, essentially incorporates a pair of stationary scroll members having wraps which mesh with both scroll wraps on the orbiting scroll member. It is to be noted that the setting of the positions of the pair of stationary scroll members and setting of the position of the orbiting scroll member cannot be done with high accuracy by the aforementioned method relying upon measurement of minimal torque. This is because the determination of scroll member positions relying upon measurement of the minimal torque is difficult to conduct due to the fact that the position setting which minimizes the torque acting between the orbiting scroll member and one of the stationary scroll members does not coincide with the position setting which minimizes the torque between the orbiting scroll member and the other scroll member.

Another problem encountered with oil-less scroll compressors, in particular air compressors, is that a suitable cooling measure has to be taken in view of the high temperature of the compressed gas, i.e., air, which well reaches 200° C. or so. Namely, an oil-less scroll compressor in operation exhibits a high temperature of 200° C. or so, since no lubricating oil which would serve as a coolant is introduced into the compression chamber of the compressor of this type. Such a high temperature tends to cause thermal distortion of both the orbiting and stationary scroll members, resulting in an increase in the gap between the meshing wraps or mutual contact between these wraps so as to make the rotational operation impossible. Consequently, the compression efficiency is impaired and, in the worst case, the compressor cannot operate at all.

SUMMARY OF THE INVENTION

Accordingly, an object of the present invention is to provide a double scroll compressor having an orbiting scroll member which is provided on both sides-thereof with scroll wraps, as well as a method of assembling such a double scroll compressor, wherein synchronization is achieved easily and accurately between a crankshaft and an auxiliary crankshaft which drive the orbiting scroll member, so as to make it possible to easily and accurately effect setting of positions of the orbiting scroll member and both stationary scroll members, i.e., adjustment of phase of rotation of the orbiting scroll member with respect to each stationary scroll member.

A second object of the present invention is to provide an oil-less double scroll compressor in which an efficient cooling is achieved to improve the performance, i.e. compression efficiency of the compressor is maintained while avoiding mutual contact of the scroll members due to thermal distortion.

To achieve the first object, according to a first aspect of the present invention there is provided a scroll compressor comprising: an orbiting scroll member having an end plate and scroll wraps on both surfaces of the end plate; stationary scroll members disposed on both sides of the orbiting scroll member; a crankshaft and an auxiliary crankshaft which are supported at their both ends by both the stationary scroll members and which cooperate with each other to drive the orbiting scroll member; stationary scroll phase fixing means for locating both stationary scroll members provided on both sides of the orbiting scroll member to each other in a predetermined phase position relation; crankshaft phase fixing means for locating the crankshaft and the stationary scroll members in a predetermined phase position relation; auxiliary crankshaft phase fixing means for locating the auxiliary crankshaft and the stationary scroll members in a predetermined phase position relation; and rotation synchronizing means for drivingly connecting the crankshaft and the auxiliary crankshaft to each other while the crankshaft and the auxiliary crankshaft are located in phase with each other by the phase fixing means and, after the crankshaft phase fixing means and the auxiliary crankshaft fixing means are dismissed, driving the crankshaft and the auxiliary crankshaft such that they rotate in synchronization with each other.

According to a second aspect of the present invention there is provided a scroll compressor comprising: an orbiting scroll member having an end plate and scroll wraps on both sides of the end plate; stationary scroll members disposed on both sides of the orbiting scroll member; a crankshaft and an auxiliary crankshaft which are supported at their both ends by both the stationary scroll members and which cooperate with each other to drive the orbiting scroll member; means for driving the crankshaft and the auxiliary crankshaft in synchronization with each other; locating members provided on one of the stationary scroll members so as to oppose adjacent axial end surfaces of the crankshaft and the auxiliary crankshaft; knock-pin holes provided in both the stationary scroll members on both sides of the orbiting scroll member so as to locate the stationary scroll members relative to each other; knock-pin holes formed in the locating members and the stationary scroll member so as to locate the locating members and the stationary scroll relative to each other; and knock-pin holes formed in the locating members and the crankshaft and the auxiliary crank shaft so as to locate the crankshaft and the auxiliary crankshaft relative to corresponding locating members.

According to a third aspect of the invention there is provided a scroll compressor comprising: an orbiting scroll member having an end plate and spiral wraps formed on both sides of the end plate so as to project therefrom in opposite axial directions; a pair of stationary scroll members disposed on both sides of the orbiting scroll member, each the stationary scroll member having an end plate and a spiral wrap for meshing in engagement with the one of the scroll wraps of the orbiting scroll member facing the stationary scroll member; a crankshaft and an auxiliary crankshaft which are rotatably supported by both stationary scroll members so as to rotate to cause an orbiting motion of the orbiting scroll member; a timing belt for drivingly connecting the crankshaft and the auxiliary crankshaft to each other, thereby causing the crankshaft and the auxiliary crankshaft to rotate in synchronization with each other; bearing covers attached to one of the stationary scroll member, such that an axial end surface of the crankshaft and a bearing associated therewith are covered by one of the bearing covers while the adjacent axial end surface of the auxiliary crankshaft and a bearing associated therewith are covered by the other bearing cover; knock-pin holes formed in outer peripheral flanges of both stationary scroll members so as to locate the stationary scroll members to each other; knock-pin holes formed in the bearing cover and the stationary scroll member so as to locate the bearing covers and the stationary scroll member relative to each other; and knock-pin holes formed in the bearing covers and the crankshaft and the auxiliary crankshaft so as to locate the crankshaft and the auxiliary crankshaft relative to the associated bearing covers.

According to a fourth aspect of the invention there is provided a method of assembling a scroll compressor of the type comprising an orbiting scroll member an end plate and scroll wraps on both sides of the end plate, stationary scroll members disposed on both sides of the orbiting scroll member, and a crankshaft and an auxiliary crankshaft which are supported at their both ends by both the stationary scroll members and which cooperate with each other to drive the orbiting scroll member, the method comprising the steps of: locating the stationary scroll members provided on both sides of the orbiting scroll member to each other by means of a knock pin; locating the crankshaft and the auxiliary crankshaft in predetermined positional relationships relative to the stationary scroll member by respective locating pins; drivingly connecting, while the crankshaft and the auxiliary crankshaft are located relative to the stationary scroll member by the knock pins, the crankshaft and the auxiliary crankshaft to each other so as to fix the crankshaft and the auxiliary crankshaft in a predetermined phase relation; and freeing the crankshaft and the auxiliary crankshaft from the stationary scroll member so as to permit the crankshaft and the auxiliary crankshaft to rotate in synchronization with each other.

According to a fifth aspect of the invention there is provided a method of assembling a scroll compressor of the type which comprises: scroll compressor comprising: an orbiting scroll member having an end plate and spiral wraps formed on both sides of the end plate so as to project therefrom in opposite axial directions; a pair of stationary scroll members disposed on both sides of the orbiting scroll member, each the stationary scroll member having an end plate and a spiral wrap for meshing in engagement with the one of the scroll wraps of the orbiting scroll member facing the stationary scroll member; a crankshaft and an auxiliary crankshaft which are rotatably supported by both stationary scroll members so as to rotate to cause an orbiting motion of the orbiting scroll member; a timing belt for drivingly connecting the crankshaft and the auxiliary crankshaft to each other thereby causing the crankshaft and the auxiliary crankshaft to rotate in synchronization with each other; and bearing covers attached to one of the stationary scroll member, such that an axial end surface of the crankshaft and a bearing associated therewith are covered by one of the bearing covers while the adjacent axial end surface of the auxiliary crankshaft and a bearing associated therewith are covered by the other bearing cover; the method comprising the steps of: forming locating knock-pin holes in both stationary scroll members, the bearing covers and the crankshaft and the auxiliary crankshaft; forming scroll wraps of both stationary scroll members by using the knock holes as references, bringing the stationary scroll members together such that their locating knock-pin holes are aligned, inserting a knock pin into the aligned knock-pin holes and then tightening bolts so as to fix the stationary scroll members to each other; locating the bearing covers with respect to the stationary scroll member by means of the knock-pin hole and a knock pin; locating and fixing the crankshaft and the auxiliary crankshaft with respect to the associated bearing covers by means of the knock-pin holes and knock pins, under such a condition that the cranks of the crankshaft and the auxiliary crankshaft have been at full eccentricity in the same specific direction; drivingly connecting the crankshaft and the auxiliary crankshaft to each other, while the crankshaft and the auxiliary crankshaft are still fixed to the bearing covers by the knock pins, thus achieving a synchronous driving connection between the crankshaft and the auxiliary crankshaft; and freeing the crankshaft and the auxiliary crankshaft so as to enable said crankshaft and the auxiliary crankshaft to rotate in synchronization with each other.

To achieve the aforesaid second object, according to the present invention there is also provided a scroll compressor comprising: an orbiting scroll member having an end plate and spiral wraps formed on both sides of the end plate so as to project therefrom in opposite axial directions; a pair of stationary scroll members disposed on both sides of the orbiting scroll member, each the stationary scroll member having an end plate and a spiral wrap for meshing in engagement with the one of the scroll wraps of the orbiting scroll member facing the stationary scroll member; a crankshaft and an auxiliary crankshaft which are rotatably supported by both stationary scroll members so as to rotate to cause an orbiting motion of the orbiting scroll member; a timing belt for drivingly connecting the crankshaft and the auxiliary crankshaft to each other, thereby causing the crankshaft and the auxiliary crankshaft to rotate in synchronization with each other; cooling fins formed on the outer surfaces of both stationary scroll members so as to extend in a direction parallel to a line interconnecting the axes of the crankshaft and the auxiliary crankshaft; and a cooling blower for forcibly supplying a cooling medium such that the cooling medium flows along said cooling fins.

In general, a double scroll compressor having scroll wraps provided on both sides of an orbiting scroll member is inferior with respect to assembly precision to a scroll compressor of the type which has a scroll wrap on only one side of the orbiting scroll member, due to the difficulty encountered in setting the positions of both stationary scroll members with respect to the orbiting scroll member. The present invention overcomes this difficulty in the following manner, thus realizing a high degree of locating and assembly precision.

The pair of scroll members, referred to also as left and right stationary scroll members, are disposed on both sides of the orbiting scroll member. Each of the stationary scroll members is provided with a locating knock-pin hole, and the scroll wrap of each stationary scroll member is formed by using this knock-pin hole as a reference. In the assembly, the left and right stationary scroll members are located in a predetermined phase relation to each other by using a knock pin which is inserted into the knock-pin holes formed in both stationary scroll members and aligned with each other when both stationary scroll members are brought together.

The setting of positions of the stationary scroll members and the orbiting scroll member with respect to each other is achieved by using the crankshaft and the auxiliary crankshaft. The crankshaft is set in a predetermined phase positional relationship to the stationary scroll member by the crankshaft phase fixing means. Similarly, the auxiliary crankshaft is set in a predetermined phase positional relationship to the stationary scroll member by the auxiliary crankshaft phase fixing means. The crankshaft and the auxiliary crankshaft, while being fixed by the respective phase fixing means, are drivingly coupled to each other through a synchronous rotational driving means such as, for example, a belt, so as to fix the phase relation between the crankshaft and the auxiliary crankshaft. Then, the respective phase fixing means are relieved so as to enable the crankshaft and the auxiliary crankshaft to rotate in synchronization with each other. It is thus possible to set the positions of the stationary scroll members and the orbiting scroll member with high accuracy with respect to each other, though the intermediary of the crankshaft and the auxiliary crankshaft.

More specifically, knock-pin holes are formed in axial end surfaces of the crankshaft and the auxiliary crankshaft at locations which are concentric with the maximum eccentric positions of the crank radii (positions which are in the same directions as the direction of maximum eccentricity of the cranks). On the other hand, locating members such as, for example, bearing covers are located on the stationary scroll members by means of knock pins inserted into knock-pin holes formed through the locating members and the stationary scroll members, such that one of the locating members opposes the axial end of the crankshaft while the other faces the axial end of the auxiliary crankshaft. Knock-pin holes are formed in the respective locating members at such positions which are aligned with the above-mentioned knock-pin holes formed in the axial end surfaces of the crankshaft and the auxiliary crankshaft when the cranks of the crankshaft and the auxiliary crankshaft are in the maximum eccentricity positions. Knock pins are inserted into the respective pairs of aligning knock-pin holes, so that the stationary scroll members and the orbiting scroll member are located with each other with a high accuracy. In this state, the crankshaft and the auxiliary crankshaft are drivingly connected to each other through a timing belt, and the knock-pins are removed to free the crankshaft and the auxiliary crankshaft from the locating members, so as to free the crankshaft and the auxiliary crankshaft, thus completing the assembly process.

Temperature in the compression chambers of an oil-less compressor rises to level as high as about 200° C., because lubricating oil which would serve as a coolant is not supplied into the chambers during the compression stroke. In the scroll compressor of the present invention, cooling fins are formed on the external surfaces of the stationary scroll members so as to extend in the direction parallel to a line interconnecting the axes of the crankshaft and the auxiliary crankshaft, and a cooling medium such as cooling air is forcibly supplied to flow along these fins by a cooling blower. Since the cooling medium can smoothly flow through the passages defined by the cooling fins, efficiency of heat exchange between the cooling medium and the stationary scroll members is enhanced so that heat generated by the fluid under compression in the compression chambers can effectively be carried away, whereby the temperature of the compressed fluid discharged from the compressor can be lowered effectively. It is thus possible to prevent thermal distortion of the orbiting scroll member and stationary scroll members, thus avoiding impairment of performance due to increase in the gaps between meshing scrolls and operation failure which otherwise may be caused by interference between the meshing wraps due to thermal distortion.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
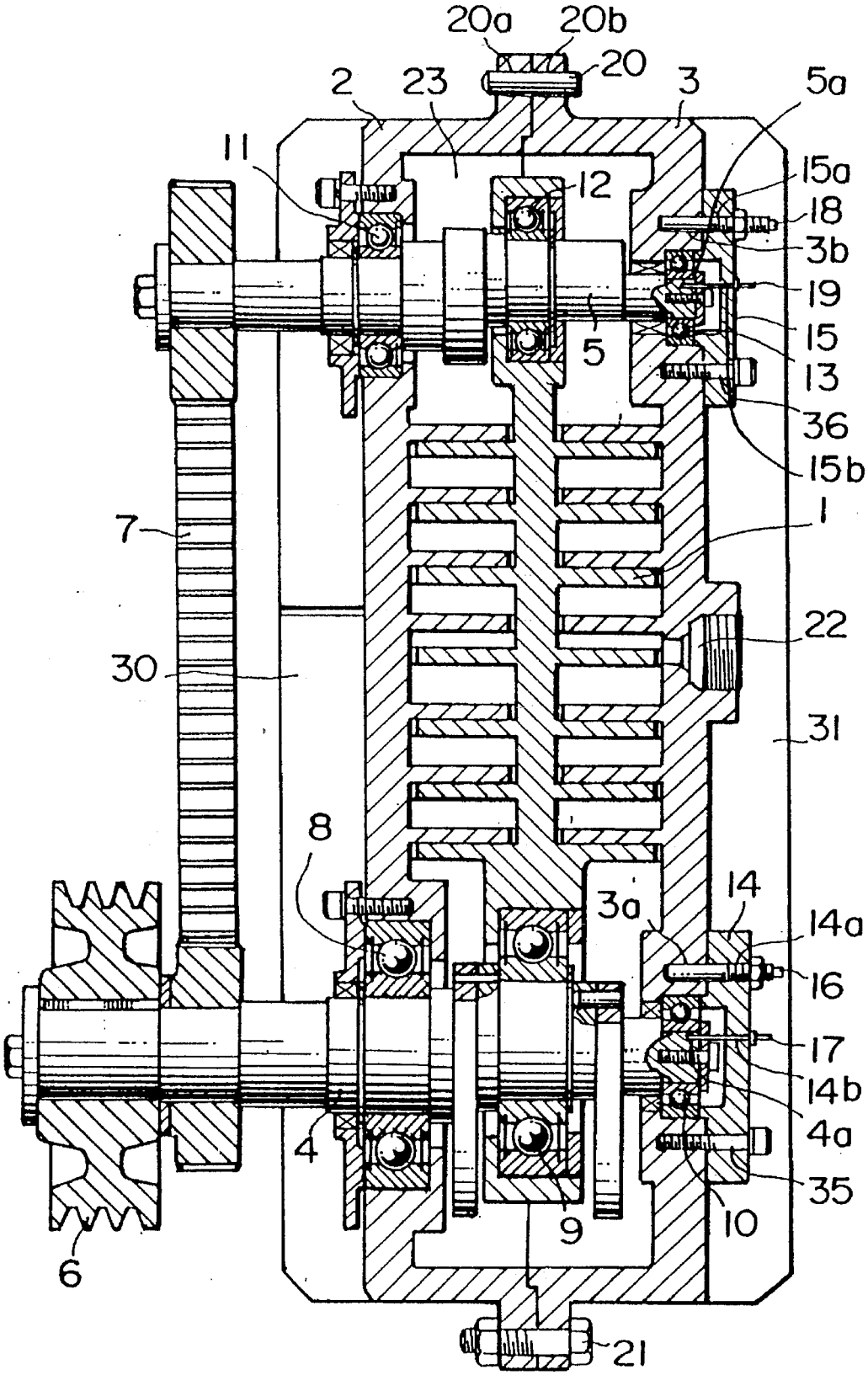
FIG. 1 is a vertical sectional view of an embodiment of a scroll compressor in accordance with the present invention.

A scroll compressor in accordance with the present invention includes, as its basic components, a first stationary scroll member (referred to also as a "left stationary scroll member"), a second stationary scroll member (referred to also as a "right stationary scroll member"), an orbiting scroll member, and a crankshaft and an auxiliary crankshaft for driving these orbiting scroll member.

In order to achieve correct phase positional relationship between the stationary scroll members and the orbiting scroll members, the compressor is assembled by using, as locating references, knock-pin holes formed in the stationary scroll members. More specifically, setting of positions of scroll wrap surfaces of the left and right stationary scroll members is done by means of knock-pin holes provided in outer peripheral flanges of these stationary scroll members. Setting of position of the right stationary scroll member with respect to the orbiting scroll member is achieved by using knock-pin holes provided in the right stationary scroll member at portions adjacent to axial ends of the crankshaft and the auxiliary crankshaft, and knock-pin holes formed in bearing covers which cover the bearings of the crankshaft and the auxiliary crankshaft and which have been located with respect to the stationary scroll member by means of knock-pin holes. Namely, locating-pin holes are formed at positions corresponding to the top dead center positions of the cranks of the crankshaft and the auxiliary crankshaft. Knock pins are driven into these locating knock-pin holes and corresponding locating knock-pin holes formed in end surfaces of the crankshaft and the auxiliary crankshaft. The arrangement is such that the resistance torque acting between the orbiting scroll member and the stationary scroll members is minimum when the cranks of the crankshaft and the auxiliary crankshaft are at the top dead center. It is thus possible to obtain matching of phase between the scroll wrap surfaces of the stationary scroll members and the scroll wrap surface of the orbiting scroll member. In this state, the crankshaft and the auxiliary crankshaft are drivingly connected by a timing belt so as to establish a correct phase relation between the crankshaft and the auxiliary crankshaft. Then, fixing bolts are driven to fasten the peripheral flanges of the stationary scroll members, and the knock pins are removed from the locating knock-pin holes which have inserted into the locating knock-pin holes in the axial ends of the crankshaft and the auxiliary crankshaft through the corresponding locating knock-pin holes formed in the bearing covers, thus completing the assembly. In this state, the orbiting scroll member can perform smooth orbiting motion with respect to the stationary scroll members so as to realize the compression function as a double scroll compressor.

The double scroll compressor having scroll wraps of the same configuration on both sides of the orbiting scroll member receives the same level of pressure at its both sides during the operation of the compressor. In a specific form of the invention, cooling fins of large surface areas are provided on the outer surface of the left stationary scroll member. Similar cooling fins are also provided on the outer surface of the right stationary scroll member. A cooling medium such as cooling air is supplied forcibly to flow along these fins by means of an external blower, so that the compressor which is heated by the heat generated in the course of compression is effectively cooled, so as to lower the temperature of the gas discharged from the compressor. According to this arrangement, cooling efficiency of the oil-less double scroll compressor can be improved so as to offer an improvement in the compression performance, while eliminating operation failure which otherwise may be caused by mutual contact of mating scroll wraps due to thermal distortion. It is thus possible to realize an oil-less scroll compressor having a large capacity.

The double scroll having scroll wrap surfaces on both sides of orbiting scroll member, compression chambers are formed on both sides of the orbiting scroll member. It is therefore possible to reduce the scroll outside diameter as compared with the single scroll compressor having a scroll wrap on only one side of the orbiting scroll member. Since pressures of an equal level acts in both compression chambers, axial forces acting on the orbiting scroll member in counter directions are balanced with each other, thus eliminating any substantial axial thrust which is one of the critical problem encountered in scroll compressors. This feature offers a great advantage particularly in oil-less scroll compressors in which no lubricant is supplied between the orbiting and stationary scroll members. Thus, the double scroll compressor of the invention can suitably be designed as an oil-less compressor.

A practical embodiment of the present invention will be described with reference to FIGS. 1 to 4.

A fluid to be compressed is sucked through a suction port 24 and flows along a suction passage 23 so as to be introduced into compression chambers defined between the wrap surfaces on both sides of an orbiting scroll member 1 and mating scroll wraps of left and right scroll members 2 and 3. As a result of orbiting motion of the orbiting scroll member 1, the volumes of the compression chambers are progressively decreased so that the fluid in these compression chambers is progressively compressed. The compressed fluid is then discharged from a discharge port 22. The driving system for driving the orbiting scroll member 1 includes a driving power source such as an electric motor (not shown). The output power of the electric motor is transmitted through V-belts (not shown) to a V-belt pulley 6 which is fixed to one end of a crankshaft 4, so that the crankshaft 4 is driven by the output power of the motor. The crankshaft 4 is provided with a load-side bearing 8, a crank bearing 9 and a counter-load side bearing 10 which in cooperation bear the load including the load acted by the gas under compression.

The driving system further includes an auxiliary crankshaft 5 which is drivingly connected through a timing belt 7 to the crankshaft 4 so as to be driven in synchronization therewith. The auxiliary crankshaft 5 is supported, as is the case of the crankshaft 4, by a load-side bearing denoted by 11, crank bearing denoted by 12 and a counter-load bearing denoted by 13. Bearing covers 14, 15 are attached to the right scroll member 3 so as to oppose the right ends of the crankshaft 4 and the auxiliary crankshaft 5 as viewed in FIG. 1. These bearing covers 14, 15 serve to fix the counter-load side bearings 10 and 13 against movement in the axial direction of the right stationary scroll member 3. The orbiting scroll member 1 is drivingly connected to the crankshaft 4 and the auxiliary crankshaft 5 through the crank bearings 9 and 12 so as to perform an orbiting motion over a stroke corresponding to the radius of the cranks of the crankshaft 4 and the auxiliary crankshaft 5, whereby volumes of the compression chamber defined between the orbiting scroll member and the left and right stationary scroll members are changed to compress the fluid sucked into these chambers.

The illustrated embodiment employs the following structures, in order to facilitate the setting of positions of the scroll wrap surfaces of the left and right stationary scroll members 2, 3 with respect to the scroll wrap surfaces of the orbiting scroll member 1. The left stationary scroll member 2 and the right stationary scroll member 3 are machined by using, as references, machined holes (knock-pin holes) **20*a* and 20*b* serving as locating holes, respectively. In the assembly of the compressor, a knock pin 20 is driven through these knock-pin holes 20*a*, 20*b*** so that the left and right stationary scroll members are aligned with each other with a high accuracy.

The setting of the position of the right stationary scroll member 3 with respect to the orbiting scroll member 1 is done in the following manner. Knock-pin holes **3*a*, 3*b* are formed around portions of the right stationary scroll member 3 which receive the counter-load side bearings 10 and 13 for supporting the crankshaft 4 and the auxiliary crankshaft 5. More specifically, the knock-pin hole 3*a* is formed adjacent to the crankshaft 4, while the knock-pin hole 3*b* is formed adjacent to the auxiliary crankshaft 5. Knock-pin holes 14*a* and 15*a* are also formed in the bearings covers 14 and 15, so as to correspond to the knock-pin holes 3*a* and 3*b*, respectively. In the assembly process, the bearing covers 14 and 15 are positioned such that their knock-pin holes 14*a* and 15*a*** are brought into alignment with the knock-pin holes 3*a* and 3*b*, and knock pins 16 and 18 are driven into the aligned pairs of knock-pin holes 3*a*, 14*a* and 3*b*, 15*a*, whereby the bearing covers 14 and 15 are located with a high positional accuracy with respect to the right stationary scroll member 3.

A knock-pin hole 4*a* is formed in an axial end surface of the crankshaft 4, at such a position that it is concentric with a knock pin 17 when the radius of the crank of the crankshaft 4 is maximized. Similarly, a knock-pin hole 5*a* is formed in one axial end surface of the auxiliary crankshaft 5 at such a position that it is concentric with a knock pin 19 when the radius of the crank of the auxiliary crankshaft 5 is maximized. More specifically, the knock-pin holes 4*a* and 5*a* are so formed that these holes are at the highest points in their loci when the cranks of the respective crankshafts are at the top dead centers. Knock-pin holes 14*b* and 15*b* are formed in the bearing covers 14 and 15, such that these knock-pin holes 14*b* and 15*b* are aligned with the above-mentioned knock-pin holes 4*a* and 5*a* when the knock-pin holes 4*a* and 5*a* are at their highest positions. In the assembly process, knock pin 17 is driven into the aligned knock-pin holes 4*a*, 17b associated with the crankshaft 4 and, similarly, knock pin 19 is driven into the aligned knock-pin holes 5*a*, 15*b* associated with the auxiliary crankshaft 5, whereby the left and right stationary scroll members 2 and 3 are located to achieve optimum assembly, while the cranks of both of the crankshaft 4 and the auxiliary crankshaft 5 are at their top dead centers. In this state, both crankshafts 4 and 5 are in phase with each other. These crankshafts 4 and 5 are then drivingly coupled through the timing belt 7, while being kept in phase with each other. The knock pins 17 and 19 associated with the crankshaft 4 and the auxiliary crankshaft 5 are then pulled out to free the crankshaft 4 and the auxiliary crankshaft 5, whereby the compressor becomes ready to operate. Numeral 21 designates bolts for tightening the left and right stationary scroll members 2 and 3 together at their flanges, while numerals 35 and 36 designates bolts for clamping and securing the bearing covers 14 and 15 to the stationary scroll member 3.

Thus, in the described embodiment, accurate setting of positions of the stationary scroll members with respect to the orbiting scroll member can easily be achieved by virtue of the knock-pins and locating knock-pin holes.

In operation of the double scroll compressor of this embodiment, heat is generated as a result of compression of the fluid in the compression chambers on both sides of the orbiting scroll member. In this embodiment, means are provided for efficiently cooling the stationary scroll members 2, 3 so as to lower the temperature of the compressed fluid (gas) to be discharged. More specifically, as shown in FIG. 1, left cooling fins 30 having large outer areas are provided on the outer surface of the left stationary scroll 2. Similarly, right cooling fins 31 are provided on the outer surface of the right stationary scroll member 3. These cooling fins 30, 31 are formed integrally with the respective stationary scroll members 2, 3 so as to extend in the direction parallel to a line interconnecting the crankshaft 4 and the auxiliary crankshaft 5, i.e., in the vertical direction as viewed in FIG. 1. It is thus possible to form the cooling fins so as to extend in the longitudinal direction of the compressor.

Figure 2:
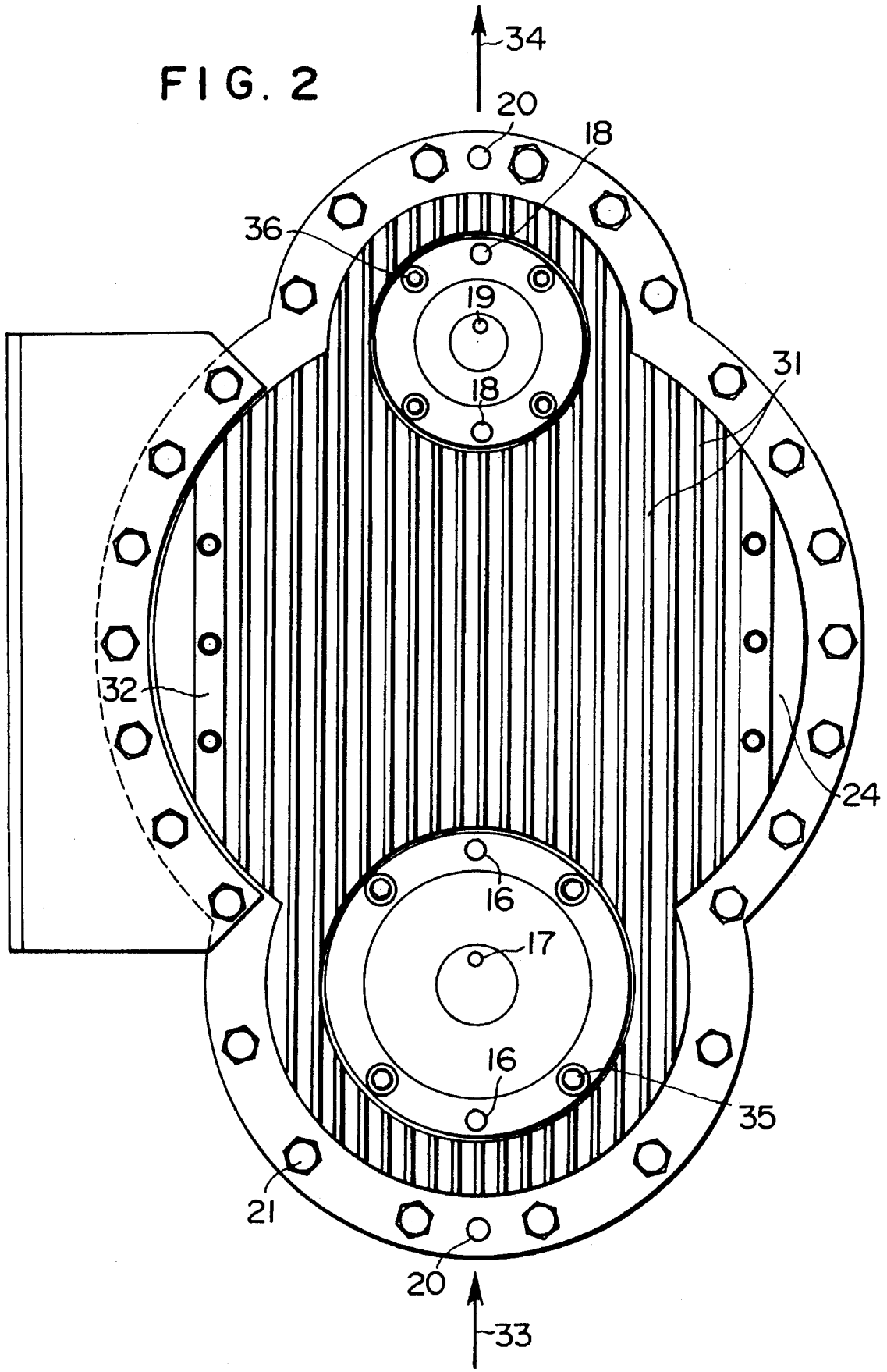
FIG. 2 is a side elevational view of the embodiment shown in FIG. 1, as viewed from the right side in FIG. 1.
Figure 3:
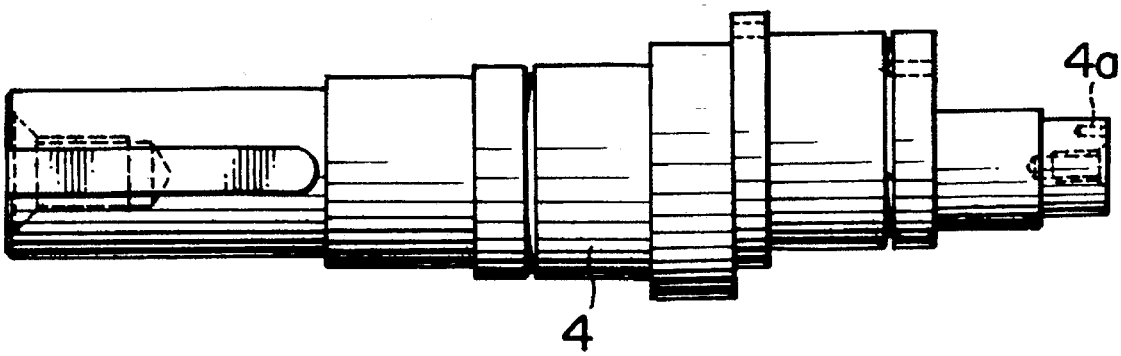
FIG. 3 is an enlarged side elevational view of a crankshaft incorporated in the scroll compressor of FIG. 1.
Figure 4:
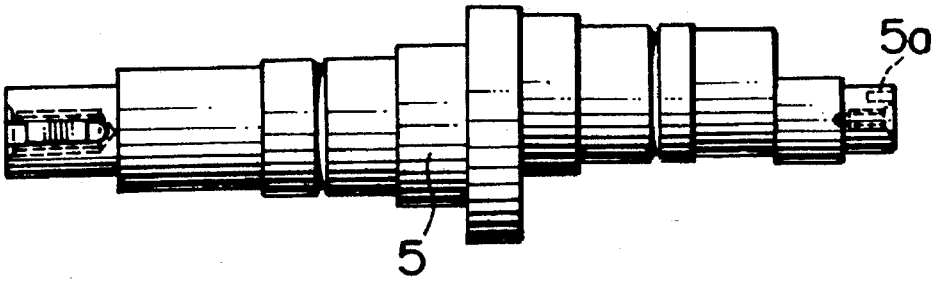
FIG. 4 is an enlarged side elevational view of an auxiliary crankshaft incorporated in the scroll compressor of FIG. 1.

FIG. 2 shows the configuration of the right cooling fins 31 on the right stationary scroll member. A duct mounting base 32 is formed on an outer frame of the fin block having the fins 31. The duct mounting base 3 mounts a duct which cooperates with the fins 31 to define passages for a cooling medium such as cooling air. An externally provided cooling blower (not shown) forcibly blows cooling air into the duct, so that the air flows from a cooling air inlet 33 of the duct to an outlet 34 thereof while exchanging heat with the fins, so as to carry away the heat generated in the scroll compressor, whereby the temperature of the discharged gas is lowered. In this embodiment, since the cooling fins are formed so as to extend in the longitudinal direction of the compressor, exchange of heat between the cooling air and the compressor can be efficiently effected. Consequently, thermal distortion of the orbiting scroll member and the stationary scroll member is suppressed, with reduced cross-sectional area of the duct.

As will be understood from the foregoing description, the following advantages are provided in accordance with the present invention.

(1) A double scroll compressor, having an orbiting scroll member and stationary scroll members on both sides of the orbiting scroll member, can easily be assembled with a high accuracy, while preserving optimum gaps between meshing wraps, simply by machining the orbiting scroll member, stationary scroll members and the crankshafts with high degree of precision. Such accurate and optimum assembly provides about 5 to 10% improvement in the compression performance of the compressor.

(2) Fluctuation in the assembly precision according to individual compressors can be suppressed, so that variation or difference in compression performance between different compressors can be minimized.

(3) Assembly of the compressor in regard to setting of positions of the stationary scroll members relative to the orbiting scroll member is facilitated, achieving about 30% reduction in the number of the assembly process.

(4) The compressor can be assembled such as to prevent mechanical contact between meshing wraps, thus achieving a remarkable improvement in the reliability, without requiring high levels of skill and experience of the workers.

(5) Cooling fins provided on both stationary scroll members reduces the temperature of the discharged gas down below 200° C., even when the compressor is of oil-less type, so as to prevent thermal distortion of the orbiting and stationary scroll members. This enables the compressor to be designed to have small gaps between meshing scroll wraps, achieving a further 10% improvement in the compression performance.

(6) Temperatures of surfaces of the orbiting and stationary scroll members are lowered so as to avoid mutual contact between the scroll members, contributing to improvement in the reliability.

(7) It is possible to design and construct oilless scroll compressors of 7.5 Kw or greater capacity, by combination of effects set forth in (5) and (6) above.

As has been fully discussed, according to the present invention there is provided a double scroll compressor having scroll wraps on both sides of an orbiting scroll member, improved to facilitate synchronization of rotation between a crankshaft and an auxiliary crankshaft which cooperatively drives the orbiting scroll member, while making it possible to set the positions of the stationary scroll members and the orbiting scroll member easily and with a high accuracy.

Furthermore, the oil-less double scroll compressor according to the present invention is provided in which, by virtue of cooling fins provided on both stationary scroll members, the compressor is effectively cooled to improve the performance, while eliminating mechanical contact between meshing scroll wraps of the mating scroll members.

What is claimed is:

1. A scroll compressor comprising:

an orbiting scroll member having an end plate and scroll wraps on both sides of said end plate;

stationary scroll members disposed on both sides of said orbiting scroll member, each said stationary scroll member having an end plate and a spiral wrap for meshing in engagement with the one of said scroll wraps of said orbiting scroll member facing said stationary scroll member;

a crankshaft and an auxiliary crankshaft supported for rotation at both ends thereof respectively by both said stationary scroll members, said crankshaft and auxiliary crankshaft being drivingly connected to said orbiting scroll member to provide orbital movement to said orbiting scroll member;

means for driving said crankshaft and said auxiliary crankshaft in synchronization with each other;

locating members provided on one of said stationary scroll members so as to oppose adjacent axial end surfaces of said crankshaft and said auxiliary crankshaft;

knock-pin holes provided in both said stationary scroll members on both sides of said orbiting scroll member so as to locate said stationary scroll members relative to each other;

knock-pin holes formed in said locating members and said one stationary scroll member so as to locate said locating members and said stationary scroll members relative to each other; and knock-pin holes formed in said locating members and said crankshaft and said auxiliary crank shaft so as to locate said crankshaft and said auxiliary crankshaft relative to corresponding ones of said locating members.

2. A scroll compressor comprising:

an orbiting scroll member having an end plate and spiral wraps formed on both sides of said end plate so as to project therefrom in opposite axial directions;

a pair of stationary scroll members disposed on both sides of said orbiting scroll member, each said stationary scroll member having an end plate and a spiral wrap for meshing in engagement with the one of said scroll wraps of said orbiting scroll member facing said stationary scroll member;

a crankshaft and an auxiliary crankshaft supported for rotation at both ends thereof respectively by both said stationary scroll members, said crankshaft and auxiliary crankshaft being drivingly connected to said orbiting scroll member to provide orbital movement to said orbiting scroll member;

a timing belt for drivingly connecting said crankshaft and said auxiliary crankshaft to each other, thereby causing said crankshaft and said auxiliary crankshaft to rotate in synchronization with each other;

bearing covers attached to one of said stationary scroll members, such that an axial end surface of said crankshaft and a bearing associated therewith are covered by one of said bearing covers while the adjacent axial end surface of said auxiliary crankshaft and a bearing associated therewith are covered by the other bearing cover;

knock-pin holes formed in outer peripheral flanges of both stationary scroll members so as to locate said stationary scroll members to each other;

knock-pin holes formed in said bearing cover and said stationary scroll member so as to locate said bearing covers and said stationary scroll member relative to each other; and knock-pin holes formed in said bearing covers and said crankshaft and said auxiliary crankshaft so as to locate said crankshaft and said auxiliary crankshaft relative to the associated bearing covers.

3. A method of assembling a scroll compressor of the type comprising an orbiting scroll member having an end plate and scroll wraps on both sides of said end plate, stationary scroll members disposed on both sides of said orbiting scroll member, each said stationary scroll member having an end plate and a spiral wrap for meshing in engagement with the one of said scroll wraps of said orbiting scroll member facing said stationary scroll member, and a crankshaft and an auxiliary crankshaft supported for rotation at both ends thereof respectively by both said stationary scroll members, said crankshaft and auxiliary crankshaft being drivingly connected to said orbiting scroll member to provide orbital movement to said orbiting scroll member, said method comprising the steps of:

locating said stationary scroll members on both sides of said orbiting scroll member to each other by means of first knock pins;

locating said crankshaft and said auxiliary crankshaft in predetermined positional relationships relative to one of said stationary scroll members by respective second knock pins;

drivingly connecting, while said crankshaft and said auxiliary crankshaft are located relative to said one stationary scroll member by said second knock pins, said crankshaft and said auxiliary crankshaft to each other so as to fix said crankshaft and said auxiliary crankshaft in a predetermined phase relation; and freeing said second knock pins from said crankshaft and said auxiliary crankshaft with respect to said one stationary scroll member so as to permit said crankshaft and said auxiliary crankshaft to rotate in synchronization with each other.

4. A method of assembling a scroll compressor of the type which comprises: scroll compressor including: an orbiting scroll member having an end plate and spiral wraps formed on both sides of said end plate so as to project therefrom in opposite axial directions; a pair of stationary scroll members disposed on both sides of said orbiting scroll member, each said stationary scroll member having an end plate and a spiral wrap for meshing engagement with the one of said scroll wraps of said orbiting scroll member facing said stationary scroll member; a crankshaft and an auxiliary crankshaft supported for rotation at both ends thereof respectively by both said stationary scroll members, said crankshaft, and auxiliary crankshaft being drivingly connected to said orbiting scroll member to provide orbital movement to said orbiting scroll member; a timing belt for drivingly connecting said crankshaft and said auxiliary crankshaft to each other to thereby cause said crankshaft and said auxiliary crankshaft to rotate in synchronization with each other; and bearing covers attached to one of said stationary scroll members, such that an axial end surface of said crankshaft and a bearing associated therewith are covered by one of said bearing covers while the adjacent axial end surface of said auxiliary crankshaft and a bearing associated therewith are covered by the other bearing cover;

said method comprising the steps of:

forming first knock-pin holes in both of said stationary scroll members, second knock-pin holes in said bearing covers and in one of said stationary scroll members and third knock-pin holes in said bearing covers and said crankshaft and said auxiliary crankshaft;

forming scroll wraps of both stationary scroll members by using said first knock-pin holes as references, bringing said stationary scroll members together such that their first knock-pin holes are aligned, inserting first knock ping into the aligned first knock-pin holes and then tightening bolts so as to fix said stationary scroll members to each other;

locating each of said bearing covers with respect to said one stationary scroll member by aligning said second knock-pin holes and inserting corresponding second knock pins therein;

locating and fixing said crankshaft and said auxiliary crankshaft with respect to the associated bearing covers by aligning said third knock-pin holes and inserting corresponding third knock pins therein, under such a condition that the cranks of said crankshaft and said auxiliary crankshaft are at full eccentricity in the same predetermined direction;

drivingly connecting said crankshaft and said auxiliary crankshaft to each other, while said crankshaft and said auxiliary crankshaft are still fixed to said bearing covers by said third knock pins, thus achieving a synchronous driving connection between said crankshaft and said auxiliary crankshaft; and freeing said fixing of said crankshaft and said auxiliary crankshaft by removing said third knock-pins to as to enable said crankshaft and said auxiliary crankshaft to rotate in synchronization with each other.

* * * * *